US009583326B2

(12) United States Patent
Lee et al.

(10) Patent No.: US 9,583,326 B2
(45) Date of Patent: Feb. 28, 2017

(54) FOCUSING IONIZATION DEVICE AND MASS SPECTROMETER USING THE SAME

(71) Applicant: NATIONAL CHUNG HSING UNIVERSITY, Taichung (TW)

(72) Inventors: Maw-Rong Lee, Taichung (TW); Yen-Hsien Li, Taichung (TW)

(73) Assignee: NATIONAL CHUNG HSING UNIVERSITY, Taichung (TW)

( * ) Notice: Subject to any disclaimer, the term of this patent is extended or adjusted under 35 U.S.C. 154(b) by 0 days.

(21) Appl. No.: 15/057,569

(22) Filed: Mar. 1, 2016

(65) Prior Publication Data

US 2016/0260600 A1 Sep. 8, 2016

(30) Foreign Application Priority Data

Mar. 4, 2015 (TW) ..... 104106925 A

(51) Int. Cl.
*H01J 49/04* (2006.01)
*H01J 49/16* (2006.01)

(52) U.S. Cl.
CPC ..... *H01J 49/168* (2013.01); *H01J 49/0422* (2013.01)

(58) Field of Classification Search
CPC ..... H01J 49/0422; H01J 49/168
See application file for complete search history.

(56) References Cited

U.S. PATENT DOCUMENTS

2009/0209368 A1* 8/2009 Kasashima ..... A63B 37/0004 473/374
2009/0294660 A1* 12/2009 Whitehouse ..... H01J 49/045 250/288

* cited by examiner

*Primary Examiner* — Wyatt Stoffa
*Assistant Examiner* — Eliza Osenbaugh-Stewart
(74) *Attorney, Agent, or Firm* — Muncy, Geissler, Olds & Lowe, P.C.

(57) ABSTRACT

A focusing ionization device includes a ball having a surface with a plurality of dimples and a metal needle located at one side of the ball and capable of generating corona discharge. The focusing ionization device is adapted for being disposed in a mass spectrometer in a way that the ball is located at a spray path of gaseous analytes and the metal needle is located adjacent to a sample inlet of a mass analyzer. When the gaseous analytes pass through the ball, the gaseous analytes can be gathered around the metal needle, which in turn are ionized to produce analyte ions to be transmitted into the mass analyzer by a potential difference. Therefore, the focusing ionization device of the present disclosure can effectively enhance the amount of the analyte ions entering into the mass analyzer, thereby improving ion transmission efficiency. As a result, a mass spectrometer equipped with the focusing ionization device may have increased signal intensity of analyte, lowered limit of detection (LOD), and minimized detection error.

9 Claims, 6 Drawing Sheets

FOCUSING IONIZATION DEVICE AND MASS SPECTROMETER USING THE SAME

BACKGROUND OF THE INVENTION

1. Field of the Invention

The present disclosure relates generally to a focusing ionization device and more particularly, to a focusing ionization device adapted to be applied in a mass spectrometer for gathering and ionizing gaseous analytes. The present disclosure further relates to a mass spectrometer using the focusing ionization device.

2. Description of the Related Art

Recently, the mass spectrometer using atmospheric pressure chemical ionization (hereinafter referred to as 'APCI') device has been widely used in the fields of identification of synthesized compounds, detection of environmental toxic substances, analysis of energy ingredients, development of drugs, biological metabolomics or pharmacometabolomics, analysis of natural products, food analysis, etc.

In general, a mass spectrometer includes an ionization device, a mass analyzer and a detector. FIG. 1 shows a schematic diagram of ionization mechanism of commercial APCI device 10. The conventional APCI device 10 includes a metal capillary 13 inserted through a high-temperature heater 11 and having an open end 131 that opens toward a sample inlet 21 of a mass analyzer 20. When the analyte solution 30 is sprayed from the open end 131 of the metal capillary 13, the analyte solution 30 is uniformly dispersed into droplets by a nebulization gas emitted in a coaxial direction of the metal capillary 13. The droplets are then heated by the high-temperature heater 11 and evaporate into gaseous analytes 30, which in turn are ionized to form single-charged analyte ions 31 by a corona discharge needle 50 connected to a high-voltage power supply and disposed adjacent to an outlet of the high-temperature heater 11 through gas phase ion-molecule reaction. Finally, analyte ions 31 travel into the mass analyzer 20 due to a potential difference established between the corona discharge needle 50 and the mass analyzer 20, a mass spectrum is thus obtained.

As shown in FIG. 1, because the plume-like analyte ions 31 may be obtained from the conventional APCI mechanism, that is, the analyte ions 31 may form a dispersion area much larger than a sectional area of the sample inlet 21 of the mass analyzer 20, at least 50% of the analyte ions 31 cannot flow into the mass analyzer 20. As a result, the mass spectrometer equipped with the conventional APCI device has the problems that the signal strength of analyte is significantly decreased and the detection limit cannot be lowered.

In order to improve the aforesaid problems, many methods for focusing ions to be transmitted into mass spectrometer by controlling electric field such as Field Asymmetric Ion Mobility Spectrometry (hereinafter referred to as 'FAIMS') have been developed. However, FAIMS has limited effect on ion-focusing under the influence of Maxwell's equation and has limited applicability due to its large volume and expensive price as well as it is not adapted to various mass spectrometers.

SUMMARY OF THE INVENTION

In light of the above, it is an objective of the present disclosure to provide a focusing ionization device, which can be directly applied to various mass spectrometers, has good applicability, and is capable of effectively enhancing the amount of analyte ions entering into the mass analyzer to improve the signal strength of analyte and lower the detection limit of mass spectrometer.

It is another objective of the present disclosure to provide a mass spectrometer using the aforesaid focusing ionization device.

To attain the above-mentioned objective, the present disclosure provides a focusing ionization device which is adapted to be applied in a mass spectrometer including a spray nozzle for spraying gaseous analytes and a mass analyzer having a sample inlet. The focusing ionization device includes a ball having a surface with a plurality of dimples and a metal needle. The focusing ionization device is disposed inside the mass spectrometer in a way that the ball is located at a spray path of the gaseous analytes, thus the ball may have a front side facing toward the spray nozzle and a back side facing toward the mass analyzer respectively. The metal needle has a pointed tip located at the back side of the ball and adjacent to the sample inlet of the mass analyzer. As such, when the gaseous analytes sprayed from the spray nozzle flow toward the ball, the gaseous analytes can be very close to the surface of the ball because of the dimples and then are gathered around the metal needle. The gaseous analytes gathered around the metal needle are ionized to analyte ions by the metal needle, which in turn enter into the mass analyzer due to a potential difference established between the metal needle and the mass analyzer.

In comparison with the conventional APCI device, because the plume-like gaseous analytes can be efficiently collected around the metal needle, i.e. a downstream position of the back side of the ball, due to the principle of fluid dynamics and then are ionized to analyte ions which in turn pass into the mass analyzer, the focusing ionization device of the present disclosure can effectively increase the amount of analyte ions entering into the mass analyzer, thereby successfully improving ion transmission efficiency. Accordingly, when the present disclosure is used in a mass spectrometer, the mass spectrometer may have the advantages of increased signal intensity of analyte, minimized detection error and lowered detection limit.

In the focusing ionization device of the present disclosure, the metal needle may inserted in the ball and has a pointed tip facing toward the sample inlet of the mass analyzer.

In the focusing ionization device of the present disclosure, each of the plurality of dimples on the surface of the ball may have a diameter of between 1 nm and 1 mm.

In the focusing ionization device of the present disclosure, each of the plurality of dimples on the surface of the ball may have a depth of 1 nm to less than a radius of the ball.

In the focusing ionization device of the present disclosure, it is preferable that the ball is made of a material which is resistant to acidic and basic solutions, organic solvents and a high temperature of 260° C. or more, so as to prevent damage to the ball or cause erroneous analysis results.

In the focusing ionization device of the present disclosure, it is preferable that the metal needle is made of an inert metal selected from platinum, iridium, gold, osmium, palladium, rhenium, rhodium, ruthenium, alloys thereof and stainless steel, so as to avoid causing erroneous analysis results due to its reaction with the gaseous analytes and avoid reducing corona discharge effect due to rust.

On the other hand, a mass spectrometer using the aforesaid focusing ionization device is also provided in the present disclosure. The mass spectrometer includes a mass analyzer having a sample inlet, a spray nozzle for spraying gaseous analytes, and the above-mentioned focusing ionization device disposed between the mass analyzer and the spray nozzle in a way that the ball is located at a spray path of the gaseous analytes and the metal needle is located adjacent to the sample inlet of the mass analyzer.

In the mass spectrometer of the present disclosure, it is preferable that the metal needle of the focusing ionization device is disposed substantially coaxial to the sample inlet of the mass analyzer. In this way, after the gaseous analytes gathered around the metal needle are ionized, the analyte ions thus obtained can immediately travel into the mass analyzer, such that the amount of the analyte ions entering into the mass analyzer can be enhanced effectively. As a result, the mass spectrometer of the present disclosure may have the advantages of high ion transmission efficiency, minimized detection error and lowered detection limit.

A more detailed constructions and characteristics of the focusing ionization device and the mass spectrometer of the present disclosure will be more apparent upon reading the following description in conjunction with the accompanying drawings.

BRIEF DESCRIPTION OF THE DRAWINGS

The present disclosure will be described through the following embodiments with reference to the accompanying drawings wherein.

DETAILED DESCRIPTION OF EMBODIMENTS

Figure 1:
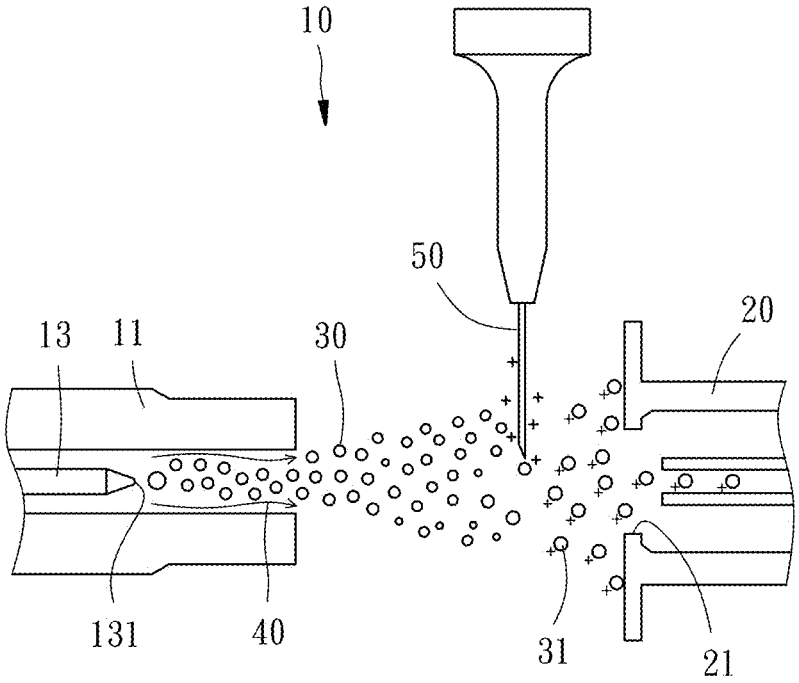
FIG. 1 (Prior Art)
FIG. 1 is a schematic diagram of ionization mechanism of commercial APCI device.

It is to be noted that the drawings of the present disclosure are not drawn in actual scale but are exaggerated to make the construction clearly understandable. In addition, like reference numerals designate like elements throughout the specification.

Figure 2:
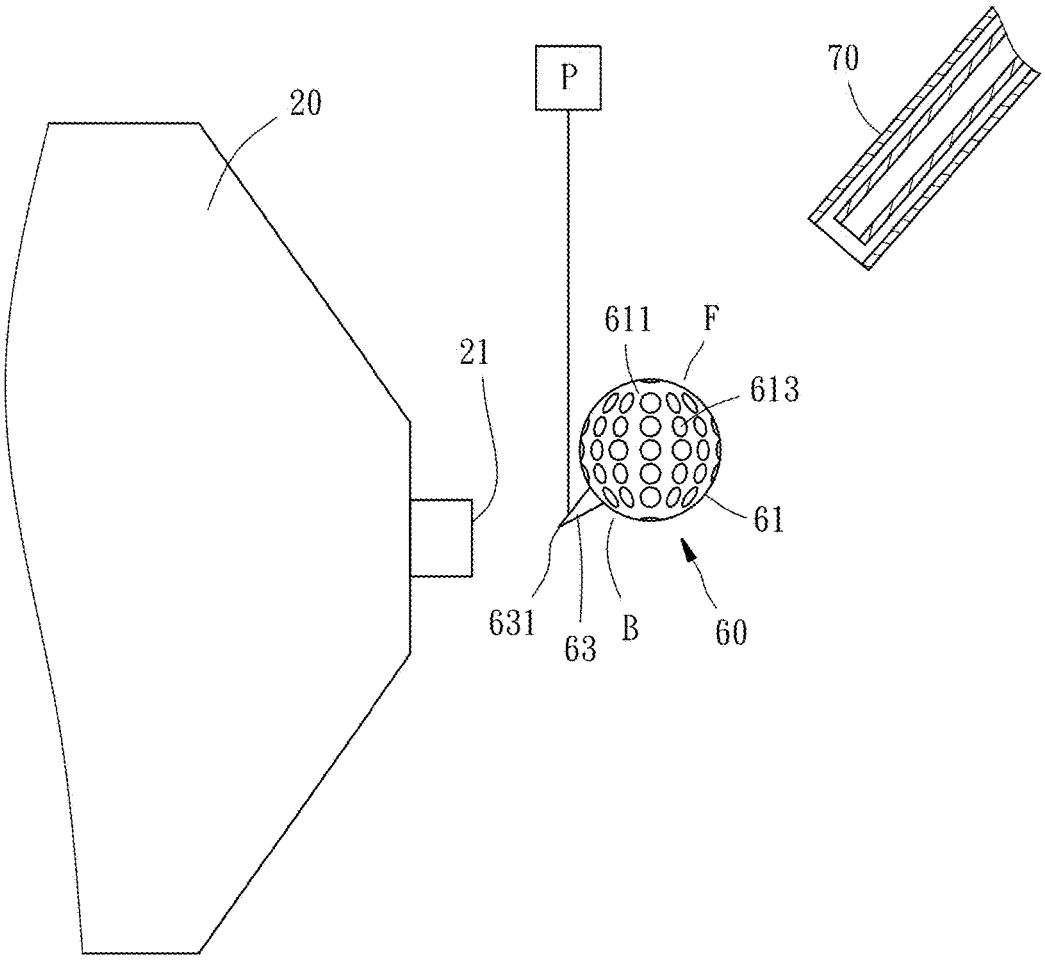
FIG. 2 is a schematic diagram showing that a focusing ionization device according to a first embodiment of the present disclosure is disposed inside an ionization chamber of a mass spectrometer.

Referring to FIG. 2, a focusing ionization device 60 according to a first embodiment of the present disclosure includes a ball 61 and a metal needle 63.

Figure 3:
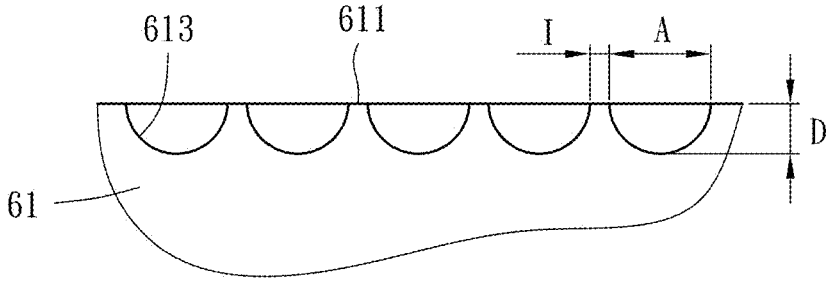
FIG. 3 is a partially enlarged cross-sectional view of the ball of the focusing ionization device according to the present disclosure.

The ball 61 has a surface 611 with a plurality of dimples 613. Preferably, the ball 61 is made of a non-conductive material resistant to acidic and basic solutions, organic solvents and a high temperature of 260° C. or more so as to prevent damage to the ball or avoid causing erroneous analysis results. For example, the ball 61 may be made of polyetheretherketone (PEEK), polyimide (PI), ceramic, or glass, and in the present embodiment the ball 61 is made of PI. Each of the plurality of dimples 613 may have, but not limited to, a cross section of a circle or an ellipse. In fact, the ball 61 may include some dimples 613 having a circular cross-section and some dimples 613 having an elliptical cross-section. Each of the plurality of dimples 613 may have a diameter A of between 1 nm and 1 mm and may have a depth D of 1 nm to less than a radius of the ball 61. There is no specific limit in the pitches I formed between the dimples 613, that is to say, the dimples 613 may be arranged equidistantly or non-equidistantly on the surface of the ball 61. As shown in FIG. 3, the "diameter" A used herein means a length of an opening of each dimple 613 formed on the surface 611, i.e. the distance along the longest axis or the shortest axis. The "depth" D used herein means a distance between the surface 611 and a bottom of the dimple 613. The "pitch" I used herein means a shortest distance between two adjacent edges of two adjacent dimples 613.

The metal needle 63 is preferably made of an inert metal selected from platinum, iridium, gold, osmium, palladium, rhenium, rhodium, ruthenium, alloys thereof and stainless steel, so as to avoid causing erroneous analysis results due to its reaction with the gaseous analytes and avoid reducing corona discharge effect due to rust. In the present embodiment, the metal needle 63 is inserted into the ball 61 in a tightly fitted manner. However, there is no specific limit in the method for fixing the metal needle 63 to the ball 61, any known method can be used. A power supply P can be used to provide a high voltage to the metal needle 63 to generate corona discharge in a pointed tip 631 of the metal needle 63, so as to ionize gaseous analytes.

In practice, as shown in FIG. 2, the focusing ionization device 60 of the embodiment is placed inside an ionization chamber of a mass spectrometer equipped with a spray nozzle 70 and a mass analyzer 20 having a sample inlet 21. There is no specific limit in the method for disposing the focusing ionization device 60 in the ionization chamber of the mass spectrometer. For example, the ball 61 may have a rod (not shown) inserted therein, and then one end of the rod can be fixed to a wall of the ionization chamber of the mass spectrometer so as to locate the ball 61 between the spray nozzle 70 and the sample inlet 21 of the mass analyzer 20. As such, a side of the ball 61 facing toward the spray nozzle 70 is defined as a front side F and another side of the ball 61 facing toward the mass analyzer 20 is defined as a back side B. The pointed tip 631 of the metal needle 63 faces toward and is adjacent to the sample inlet 21 of the mass analyzer 20.

Figure 4:
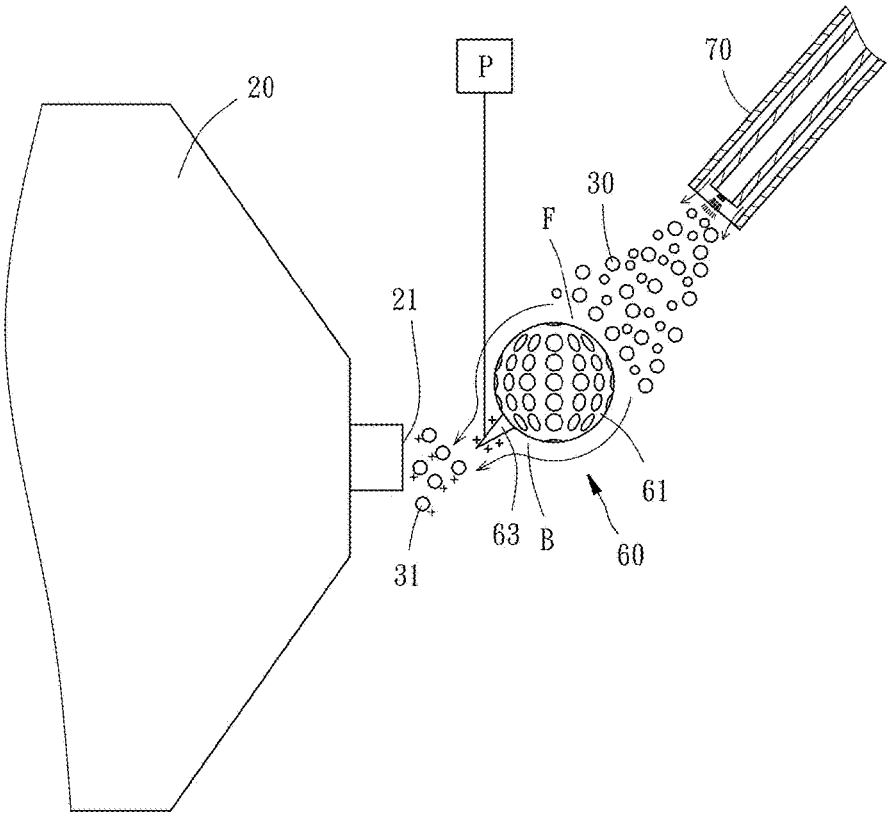
FIG. 4 is a schematic diagram showing that the focusing ionization device of the first embodiment of the present disclosure is used to gather and ionize gaseous analytes.

As shown in FIG. 4, when the gaseous analytes 30 are sprayed from the spray nozzle 70 and flow toward the front side F of the ball 61, because the laminar flow near the surface 611 of the ball 61 is disturbed by the dimples 613 on the surface 611, the plume-like gaseous analytes 30 can be very close to the surface 611 of the ball 61 when they flow through the ball 61 and then are gathered at a downstream position of the back side B of the ball 61. The gaseous analytes 30 gathered at the downstream position of the back side B are ionized by the metal needle 63 to produce analyte ions 31 which in turn flow into the mass analyzer 20 due to a potential difference established between the metal needle 63 and the mass analyzer 20, a mass spectrum is thus obtained. With the principle of fluid dynamics, the gaseous analytes 30 that may be lost in the conventional APCI can be focused between the metal needle 63 and the sample inlet 21 of the mass analyzer 20 to be ionized, thus the amount of the analyte ions 31 entering into the mass analyzer 20 can be greatly increased.

Additionally, in order to further enhance the amount of the analyte ions 31 entering into the mass analyzer 20, the metal needle 63 of the focusing ionization device 60 is preferably disposed coaxial to the sample inlet 21 of the mass analyzer 20. In this way, after the gaseous analytes 30 gathered around the metal needle 63 are ionized, the analyte ions 31 thus obtained can immediately travel into the mass analyzer 20, such that the amount of the analyte ions 31 entering into the mass analyzer 20 can be greatly increased.

Figure 5:
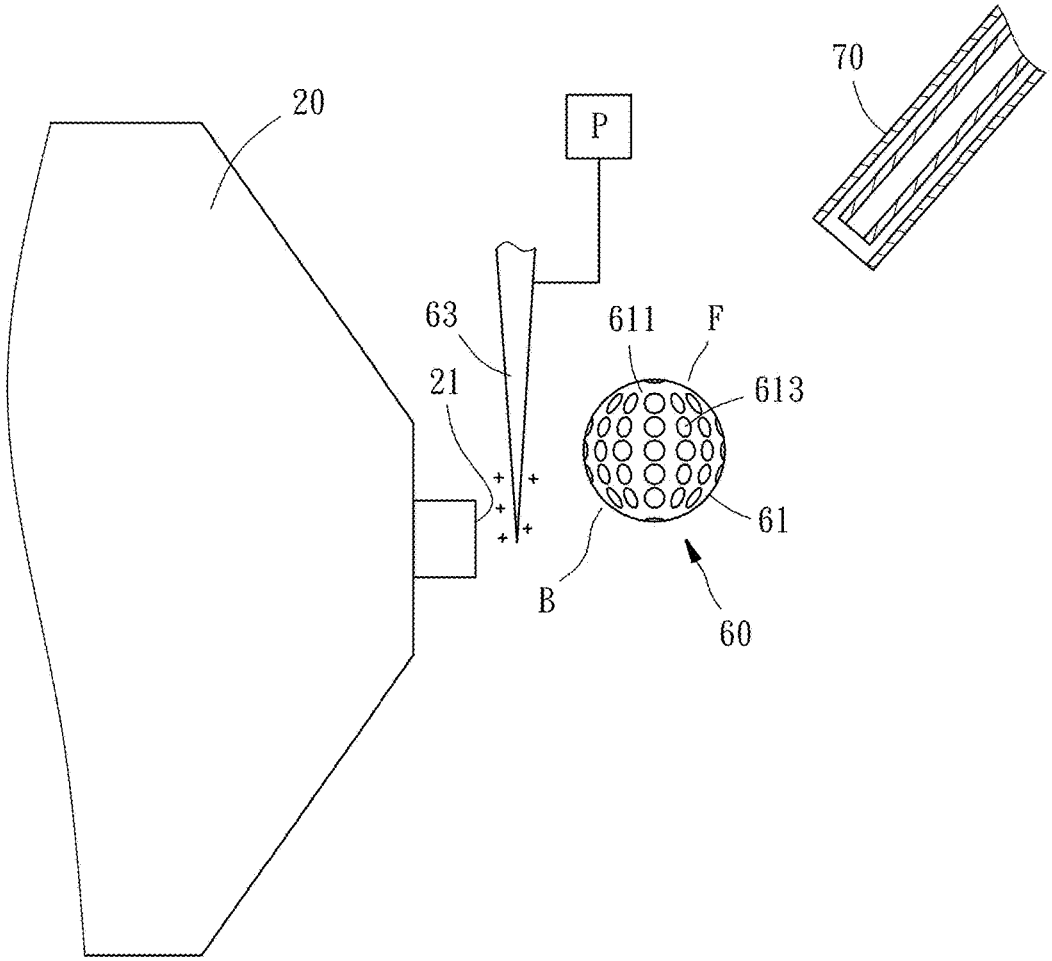
FIG. 5 is a schematic diagram showing that a focusing ionization device according to a second embodiment of the present disclosure is disposed inside an ionization chamber of a mass spectrometer.

The main concept of the present disclosure lies in that a ball 61 having a surface with a plurality of dimples 613 is firstly used to collect gaseous analytes 30 sprayed from a spray nozzle 70 to a downstream position of a back side B of the ball 61, then the gaseous analytes 30 are ionized to produce analyte ions 31. Accordingly, as shown in FIG. 5, in a focusing ionization device 60 according to a second embodiment of the present disclosure, a metal needle 63 is located at a downstream position of a back side B of the ball 61 and does not fix to the ball B. The metal needle 63 has a pointed tip 631 located between the ball 61 and a sample inlet 21 of the mass analyzer 20, more specifically, the pointed tip 631 is positioned at the downstream position of the back side B of the ball 61 and adjacent to the sample inlet 21. Thus, the gaseous analytes 30 can still be gathered and ionized to produce analyte ions 31. As a result, the amount of the analyte ions 31 entering into the mass analyzer 20 can be efficiently increased.

The present disclosure will further be clarified through the following Example. However, it should be understood by those skilled in the art that the Example is only used to illustrate the present disclosure without limiting the scope of the present disclosure. Various modification and variations can be made to present disclosure without departing from the spirit or scope of the invention.

EXAMPLE

First, astaxanthin (HPLC grade, purity higher than 98.5%, purchased from Fluka) was dissolved in acetonitrile (HPLC grade, purity higher than 99.9%, purchased from Merck) to produce a stock solution having a concentration of 5,000 ng/mL. The above-mentioned stock solution was then diluted to obtain five sample solutions having the concentrations of 1 ng/mL, 10 ng/mL, 100 ng/mL, 250 ng/mL and 500 ng/mL.

Figure 6:
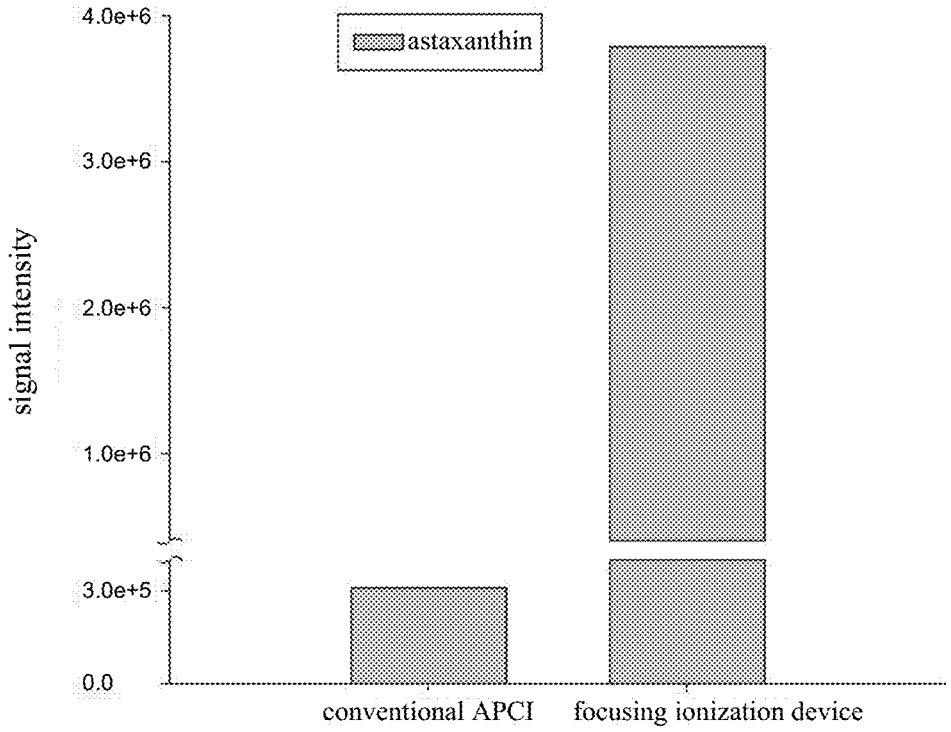
FIG. 6 is a graph showing the signal intensities of astaxanthin detected respectively by a mass spectrometer equipped with a conventional APCI device and a mass spectrometer equipped with the focusing ionization device of the present disclosure.

The mass spectrometric analyses were respectively conducted on a Finnigan TSQ Ultra EMR (purchased from Thermo Electron, San Jose, Calif., USA) equipped with a conventional APCI device and with the focusing ionization device of the second embodiment. The results are shown in FIG. 6. The optimum parameters were as follows:

Ion source temperature: 270° C.;

Sheath gas flow rate: 10 arbitrary units;

Auxiliary gas flow rate: 5 arbitrary units;

Auxiliary gas flow temperature: 330° C. in positive scan mode;

Corona current: 4 μA in positive scan mode.

From the results shown in FIG. 6, the signal intensity of astaxanthin obtained from the mass spectrometer using the focusing ionization device of the present disclosure is significantly higher than that obtained from the mass spectrometer using a conventional APCI device, and specifically, the signal intensity is increased about 12 times. Thus, it is apparently that the focusing ionization device of the present disclosure can effectively increase the amount of analyte ions entering into the mass analyzer.

In addition, the mass spectrometer using the focusing ionization device of the present disclosure has a detection limit of 0.07 pg/mL, while the mass spectrometer using the conventional APCI device has a detection limit of 2.1 pg/mL. Therefore, the focusing ionization device of the present disclosure can effectively lower the detection limit of the mass spectrometer.

As described above, because the focusing ionization device of the present disclosure can effectively gather the plume-like gaseous analytes around the metal needle, the amount of analyte ions entering into the mass analyzer can be significantly increased so as to improve ion transmission efficiency. Accordingly, when the present disclosure is used in a mass spectrometer, the mass spectrometer may have the advantages of increased signal intensity of analyte, minimized detection error and lowered detection limit. Furthermore, the present disclosure is widely used because it can be directly combined with the existing mass spectrometer.

What is claimed is:

1. A focusing ionization device adapted for being disposed in a mass spectrometer including a spray nozzle for spraying gaseous analytes and a mass analyzer having a sample inlet, the focusing ionization device comprising:

a ball having a surface with a plurality of dimples, a front side for facing toward the spray nozzle, and a back side for facing toward the sample inlet of the mass analyzer, the ball being adapted to be disposed at a spray path of the gaseous analytes; and a metal needle capable of generating corona discharge and having a pointed tip located at a downstream position of the back side of the ball, the pointed tip being adapted to be located adjacent to the sample inlet of the mass analyzer.

2. The focusing ionization device as claimed in claim 1, wherein the metal needle is inserted in the ball and has the pointed tip for facing toward the sample inlet of the mass analyzer.

3. The focusing ionization device as claimed in claim 1, wherein each of the plurality of dimples on the surface of the ball has a diameter of between 1 nm and 1 mm.

4. The focusing ionization device as claimed in claim 1, wherein each of the plurality of dimples on the surface of the ball has a depth of 1 nm to less than a radius of the ball.

5. The focusing ionization device as claimed in claim 1, wherein the ball is made of a non-conductive material resistant to acidic and basic solutions, organic solvents, and a high temperature of 260° C. or more.

6. The focusing ionization device as claimed in claim 5, wherein the ball is made of polyetheretherketone, polyimide, ceramic, or glass.

7. The focusing ionization device as claimed in claim 5, wherein the metal needle is made of an inert metal selected from the group consisting of platinum, iridium, gold, osmium, palladium, rhenium, rhodium, ruthenium, alloys thereof and stainless steel.

8. A mass spectrometer, comprising:

a mass analyzer having a sample inlet;

a spray nozzle for spraying gaseous analytes; and a focusing ionization device as claimed in claim 1 which is located between the sample inlet of the mass analyzer and the spray nozzle.

9. The mass spectrometer as claimed in claim 8, wherein the metal needle of the focusing ionization device is disposed coaxial to the sample inlet of the mass analyzer.

* * * * *